US009456730B2

(12) United States Patent
Bayer et al.

(10) Patent No.: US 9,456,730 B2
(45) Date of Patent: Oct. 4, 2016

(54) SPRAY ARM ARRANGEMENT FOR A DISHWASHER

(75) Inventors: Matthias Bayer, Zirndorf (DE); Oliver Kleinert, Furstenfeldbruck (DE)

(73) Assignee: Electrolux Home Products Corporation N.V., Brussels (BE)

( * ) Notice: Subject to any disclaimer, the term of this patent is extended or adjusted under 35 U.S.C. 154(b) by 1146 days.

(21) Appl. No.: 13/384,731

(22) PCT Filed: Jul. 16, 2010

(86) PCT No.: PCT/EP2010/004358
§ 371 (c)(1),
(2), (4) Date: Jan. 18, 2012

(87) PCT Pub. No.: WO2011/012234
PCT Pub. Date: Feb. 3, 2011

(65) Prior Publication Data

US 2012/0111380 A1 May 10, 2012

(30) Foreign Application Priority Data

Jul. 28, 2009 (EP) ..... 09009729

(51) Int. Cl.
*A47L 15/23* (2006.01)

(52) U.S. Cl.
CPC ..... *A47L 15/23* (2013.01)

(58) Field of Classification Search
CPC ..... A47L 15/23; A47L 15/22; A47L 15/18; A47L 15/20; A47L 15/4278; A47L 15/16; A47L 15/4282; A47L 2501/02
USPC ..... 134/172, 179, 198; 3/172, 179, 198
See application file for complete search history.

(56) References Cited

U.S. PATENT DOCUMENTS 1,408,077 A * 2/1922 Clinton ..... 239/227
6,357,460 B1 * 3/2002 Bertsch et al. ..... 134/174

(Continued)

FOREIGN PATENT DOCUMENTS

DE 34 28 439 A1 2/1986
DE 3 938 293 A1 5/1991
DE 10 2004 043772 A1 3/2006

(Continued)

OTHER PUBLICATIONS

International Search Report for Application No. PCT/EP2010/004358 dated Aug. 19, 2010.

(Continued)

*Primary Examiner* — David Cormier
*Assistant Examiner* — Irina Graf
(74) *Attorney, Agent, or Firm* — Alston & Bird LLP

(57) ABSTRACT

Provided herein is a spray arm arrangement for a dishwasher having: a support having a hub portion; and a spray arm having at least one arm portion with at least one spray nozzle, and a generally tubular mounting portion connected to the arm portion. The mounting portion may have first and second bearing surfaces bearing against the hub portion, with the first bearing surface being located at a shorter axial distance from the arm portion than the second bearing surface. The first bearing surface may be located within the hub portion proximate the axial end of the hub portion facing towards the arm portion, and the second bearing surface may include a projection which axially extends from said mounting portion into said hub portion.

16 Claims, 2 Drawing Sheets

(56) References Cited

U.S. PATENT DOCUMENTS

Figure 1:
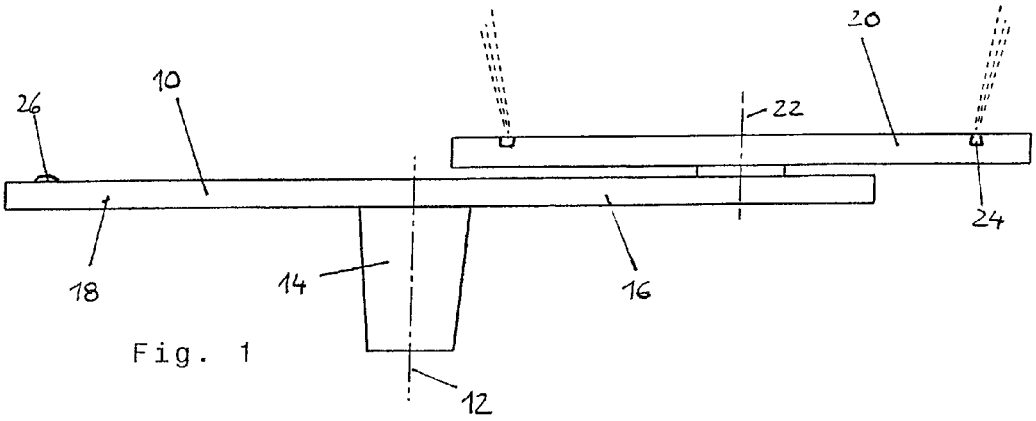

| | | | | |
|---|---|---|---|---|
| 2004/0195361 | A1 | 10/2004 | Kim | |
| 2009/0145981 | A1* | 6/2009 | Mack et al. | 239/261 |

FOREIGN PATENT DOCUMENTS

| | | | |
|---|---|---|---|
| EP | 0 509 251 | A1 | 10/1992 |
| EP | 524101 | A1 * | 1/1993 |
| EP | 1 510 168 | A2 | 3/2005 |
| EP | 1 634 526 | A2 | 3/2006 |
| FR | 2 236 468 | A1 | 2/1975 |
| GB | 1 462 398 | A | 1/1977 |
| GB | 2210257 | A * | 6/1989 |

OTHER PUBLICATIONS

International Preliminary Report on Patentability and Written Opinion from International Application No. PCT/EP2010/004358 dated Jan. 31, 2012.

Extended European Search Report from corresponding European Patent Application No. 09009729.6 dated Jan. 15, 2010.

Canadian Office Action dated Jun. 2, 2016 for Canadian Patent Application No. 2,768,580, 4 pages.

* cited by examiner

SPRAY ARM ARRANGEMENT FOR A DISHWASHER

CROSS REFERENCE TO RELATED APPLICATIONS

This application is a national stage application filed under 35 U.S.C. 371 of International Application No. PCT/EP2010/004358, filed Jul. 16, 2010, which claims priority from EP Application No. 09009729.6, filed Jul. 28, 2009, each of which is incorporated herein in its entirety.

The present invention relates to a spray arm arrangement for a dishwasher, comprising a support having a hub portion, and a spray arm having at least one arm portion comprising at least one spray nozzle, and a generally tubular mounting portion connected to the arm portion, said mounting portion having first and second bearing surfaces bearing against the hub portion, said first bearing surface being located at a shorter axial distance from the arm portion than the second bearing surface.

Such a spray arm arrangement is shown in DE-A-34 28 439. Here the support comprises a stationary tube which is affixed to the floor of the washing compartment. The spray arm has two arm portions and a central tubular mounting portion, wherein the bearing surfaces are designed as annular rims which bear against the inner side of the stationary tube which acts as hub portion.

A problem which is encountered in such spray arm arrangements is that during operation of the dishwasher the bearing surfaces and the hub portion necessarily will come into contact with each other. Due to the fact that these components usually are made of plastic and cannot be lubricated because of the cleaning liquid which during operation of the dishwasher flows through the hub portion, the repeated contact between these members results in friction and wear. Higher wear leads to a shortened period of use of the bearing support of the rotating arm. Higher friction, in addition to contributing to wear, results either in a reduced rotational speed of the rotating arm or in the necessity to compensate for the higher friction by increasing the driving torque acting on the rotating arm.

Furthermore, during operation of the dishwasher the spray arm usually does not smoothly rotate in a single plane, but rather, due to reaction forces of the water jets that are ejected from the spray arm and which, during rotation of the spray arm, impinge on surfaces that are arranged at a varying distance from the spray arm, the axis of rotation of the spray arm does is not stay strictly vertical but rather is subject to precession, which further increases the friction and wear problem.

While in most of the presently available dishwashers spray arm arrangements are employed, wherein rotatable spray arms are arranged below or above dishwasher baskets in which articles to be cleaned are arranged, which spray arms comprise a plurality of spray nozzles and are mounted on a central hub, also so-called satellite spray arm arrangements where proposed in which a rotatable spray arm is mounted on a support arm which itself is rotatably mounted within the dishwasher.

Thus, in EP 1 510 168 there is proposed a wash arm arrangement for a dishwasher which comprises a rotatable support arm and a rotatable satellite arm comprising spray nozzles and being mounted on the support arm such that the axis of rotation of the satellite arm is offset with respect to the axis of rotation of the support arm.

A similar arrangement is described in DE 10 2004 043 772 A1.

In such satellite spray arm arrangements the wear problem is even more severe due to the fact that the support arm usually carries a single satellite arm so that asymmetric loads act on the bearing support of the support arm, which result in a higher wear and hence in a shortened period of use of the bearing support of the support arm.

In view of these problems, it is an object of the present invention to provide a spray arm arrangement for a dishwasher of the type mentioned above in which the mounting portion of a rotatable spray arm or satellite arm and its respective hub portion are alleviated.

In a spray arm arrangement for a dishwasher, comprising a support having a hub portion, and a spray arm having at least one arm portion comprising at least one spray nozzle, and a generally tubular mounting portion connected to the arm portion, said mounting portion having first and second bearing surfaces bearing against the hub portion, said first bearing surface being located at a shorter axial distance from the arm portion than the second bearing surface, in accordance with the present invention the above object is solved in that the first bearing surface is located within said hub portion proximate the axial end of the hub portion facing towards the arm portion, and the second bearing surface comprises a projection, such as a tip or a nose, which axially extends from said mounting portion into said hub portion.

By locating the second bearing surface such that it axially extends from the mounting portion into the hub portion, the distance between the first and second bearing surfaces is at a maximum, and at the same time the radius of the second bearing surface is minimized. In this manner the resulting momentum created between the first and second bearing surfaces and the hub portion decreases, so that the force acting onto the bearing surfaces and hence the friction created at the bearing surfaces are minimized. In this manner the friction between the hub portion and the mounting portion is reduced. Particularly when the spray arm arrangement is comprised of moulded plastic parts, the useable life time of the spray arm arrangement thus will be improved.

While the generally tubular mounting portion, and similarly also the hub portion, may have a cylindrical configuration, it also could be provided with a conical or tapered configuration.

Preferred embodiments of the present invention are defined in the dependent claims.

In preferred embodiments of the spray arm arrangement, the hub portion comprises a central passage which is in alignment to a central passage provided in the mounting portion, wherein said second bearing surface axially extends from said hub portion into the central passage of the mounting portion.

In order to minimize the flow resistance of the second bearing surface to the flow of cleaning liquid through the central passage, the second bearing surface preferably has a streamlined cross-section in the axial direction of the hub member. To this end, the second bearing surface can be designed to have the shape of a pad or drop.

Preferably, the first bearing surface comprises one or more first projections located in the circumferential interface region between the hub portion and the mounting portion which provide for rotational support between the hub portion and the mounting portion substantially along the entire circumference of the mounting portion. By designing the bearing surfaces as projections, i.e. as members having only a relatively small surface area, the frictional area between the hub member and the mounting portion is kept at a minimum. The first bearing surface, which thus can comprise a single annular projection extending around the entire circumference of the hub portion, or a plurality of projections which are located in the circumferential interface region between the hub portion and the mounting portion, thus provides for rotational support between the hub portion and the mounting portion substantially in any radial direction.

While the hub portion can comprise a tubular member, such a pipe that is fixed to the floor of the dishwasher compartment, the hub portion also could comprise a tubular first section for accommodating the first bearing surface and an annular second section for accommodating the second bearing surface, wherein the first and second sections of the hub portion are arranged at an axial distance so as to provide a feed opening therebetween for the passage of liquid. Such latter embodiment is particularly suited if there is little space in the axial direction, i.e. vertical direction, for mounting the spray arm, such as if the spray arm is to be mounted within a dishwasher having two dishwasher baskets below the upper basket.

In order to further decrease the amount of friction which during operation of the dishwasher is exerted between the second bearing surface and the hub portion, the second bearing surface can be designed to extend over only a section of the circumference of the mounting portion.

Such latter design is of particular advantage if the spray arm comprises a rotatable support arm comprising the mounting portion and a rotatable satellite arm comprising at least one spray nozzle and being mounted on the support arm such that the axis of rotation of the satellite arm is offset with respect to the axis of rotation of the support arm. In such embodiments the second bearing surface preferably is arranged to extend over only that section of the circumference of the mounting portion where during operation of the spray arm arrangement a momentum is exerted which has a vectorial component perpendicular to the axis of rotation of the support arm. Whereas is such an arrangement the first bearing surface provides for rotational support between the hub portion and the mounting portion substantially in any radial direction, the second bearing surface provides for rotational support only in that region where a lateral momentum is exerted onto the mounting portion.

While the present concept is applicable in any spray arm arrangement in which, due to the weight distribution on the rotating arm or due to hydraulic forces acting on the spray arm during use, there is exerted a momentum on the rotating arm which tends to tilt the rotational axis of the arm in a certain direction, the present invention is of particular advantage if the spray arm comprises a support and a satellite arm, because in such an arrangement the forces acting on the bearing surfaces usually are asymmetric with respect to the axis of rotation.

The present concept thus can be employed with any conventional single spray arm or in any spray arm arrangement, wherein a spray arm, particularly a single spray arm is rotatably mounted on the support arm, in which case the support arm will be off balance during at least a part of the operation of the dishwasher, be it due to the weight of the spray arm which is mounted on the support arm or due to hydraulic forces caused by water jets which are ejected from the spray arm.

Whereas in certain embodiments the support arm can be a one-sided arm, one end of which comprises the hub portion and the other end of which supports the spray arm, in other embodiments the support arm may comprise a first leg which supports the spray arm, and a second leg opposite the first leg. The second leg may serve to at least partially compensate the weight of the first leg and the spray arm mounted thereon and/or dynamic loads acting on the spray arm during use.

Alternatively or in addition at least one spray nozzle can be provided in the second leg, so that also the support arm functions as a spray arm.

In order to cause the support arm to rotate, the support arm preferably comprises at least one spray nozzle which is angled with respect to the axis of rotation of the support arm so that a water jet which is ejected from such nozzle imparts a momentum on the support arm.

Figure 4:
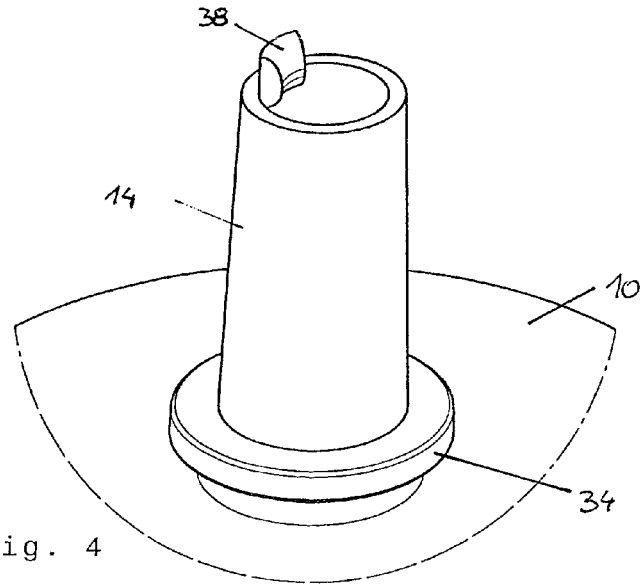
Figure 2:
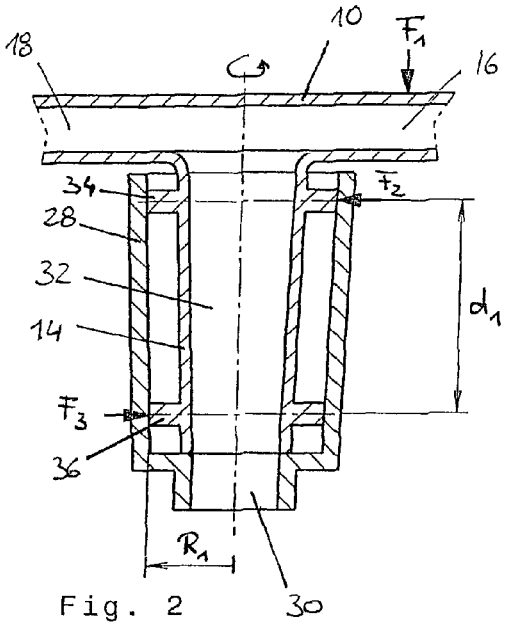
Figure 3:
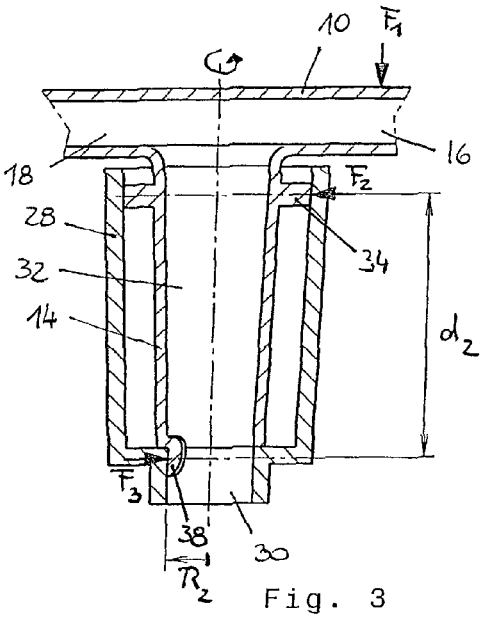
Figure 5:
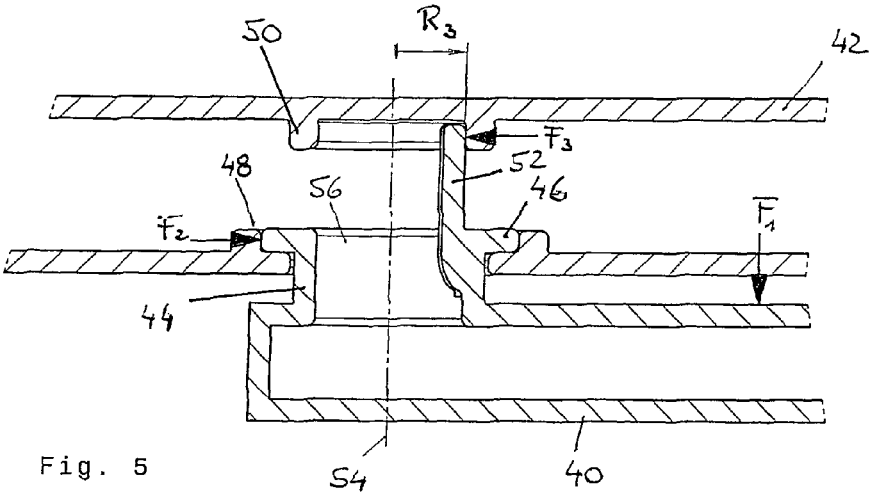

Preferred embodiments of the present invention are described with reference to the drawings in which:

FIG. 1 a schematic view of a spray arm arrangement which can be designed in accordance with the present invention;

FIG. 2 a sectional view of a conventional spray arm arrangement;

FIG. 3 a view similar FIG. 2 illustrating a spray arm arrangement made in accordance with the present invention;

FIG. 4 a perspective view of the mounting portion of the spray arm arrangement shown in FIG. 3; and FIG. 5 a sectional view of a further embodiment of a spray arm arrangement made in accordance with the present invention.

In FIG. 1 there is shown a spray arm arrangement for a dishwasher, which comprises a support arm 10 as it can be installed in the bottom of the washing compartment of a dishwasher so as to be rotatable about a central axis 12. To this end, support arm 10 comprises a central mounting portion 14, which is rotatably supported within a hub (see FIG. 3) that is stationary provided within the dishwasher. Support arm 12 comprises a first leg 16 and a second leg 18. First leg 16 carries a spray arm 20, which is mounted to be rotatable about an axis 22 which extends in parallel to axis 12 about which the support arm 10 rotates. Spray arm 20 comprises a plurality of spray nozzles 24 through which jets of cleaning liquid can be ejected onto articles to be washed which are arranged within the dishwasher compartment. At least one of the spray nozzles 24 can be arranged so as to eject a water jet at an angle to the vertical direction, so as to impart a rotational movement to the spray arm 20. Similarly, also the second leg 18 of support arm 10 can comprise spraying nozzles 26, which also can be designed to act as driving nozzles for the support arm by ejecting a water jet at an angle to the vertical direction.

By reference to FIGS. 2 and 3 the concept of providing for bearing support suggested herein will be described below. In these figures FIG. 2 shows a conventional spray arm and FIG. 3 shows a spray arm made in accordance with the present invention. In particular, FIGS. 2 and 3 show the central portion of support arm 10, the mounting portion 14 of which is arranged within a tubular hub 28, which in the support arm/satellite arm arrangement shown in FIG. 1 would be a hub that is fixedly provided within the sump of the dishwasher. Hub 28 in its lower portion comprises a central passage 30 through which during operation of the dishwasher cleaning liquid will be fed to the spray arm arrangement. Mounting portion 14 of support arm 10 likewise is a generally tubular member, which in the embodiments shown in FIGS. 2 and 3 is designed as a conical member. At its lower end, mounting portion 14 has an inner diameter which corresponds to that of the central passage 30 of hub 28. Central passage 32 of the mounting portion 14 opens, at its upper end, into the hollow arm sections 16 and 18 of support arm 10.

Mounting portion 14 comprises first and second bearing surfaces at which the support arm is bears against hub 28. In particular, a first bearing surface 34 is provided proximate the upper axial end of the hub portion, and a second bearing surface is located proximate the lower end of the mounting portion.

As can be seen from a comparison of FIGS. 2 and 3, the spray arm arrangement suggested herein differs from conventional spray arm arrangements in the arrangement and design of the second bearing surface. Thus, whereas in a conventional spray arm arrangement as it is shown in FIG. 2 both the first bearing surface 34 and the second bearing surface 36 typically are designed as annular rims which extend about the tubular mounting portion, in accordance with the present application the second bearing surface is designed as a projection which axially extends from the mounting portion into the hub portion as it is shown in FIG. 3. While such projection basically can be designed as an annular projection which extends about the entire circumference of the mounting portion, particularly when applying the concept suggested herein to an asymmetric spray arm arrangement such as shown in FIG. 1, wherein asymmetric loads are exerted onto the bearing surfaces, the second bearing surface preferably is designed as a nose, pad or tab which extends only about a section of the circumference of the mounting portion (see also FIG. 4).

By designing the second bearing surface in a manner as it is shown in FIGS. 3 and 4, the momentum acting on the bearing surfaces when there is an asymmetric load acting onto the spray arm 10 is reduced over that exerted in the conventional system shown in FIG. 2. Thus, if due to the weight distribution onto the support arm and also due to reaction forces caused by water jets that are ejected from spray arm 20 that is mounted on the first leg 16 of the support arm 10 a force F1 acts on the first leg 16 of support arm 10, such force tends to tilt support arm 10 with respect to its rotational axis 12. Thus, forces F2 and F3 are exerted between the first and second bearing surfaces 34 and 36 and the inner wall of hub 28. Since due to forces F2 and F3 a friction momentum is created when arm 10 is rotating, it is beneficial to reduce these forces so as to obtain a low friction and correspondingly little wear.

To this end, in accordance with the invention, the second bearing surface is designed as a projection which axially extends from mounting portion 14 into the hub portion 28. This designs results on the one hand in that the distance between the first and second bearing surfaces is increased and on the other hand that the radius of the second bearing surface is decreased. Thus, when comparing FIGS. 2 and 3, it is to be seen that the distance d2 of the first and second bearing surfaces of the spray arm arrangement in accordance with the invention as shown in FIG. 3 is larger than the corresponding distance d1 in the conventional device. At the same time, the radius r2 of the second bearing surface of the spray arm arrangement in accordance with the present invention shown in FIG. 3 is substantially smaller than radius r1 of the conventional arrangement. Both these measures result in that the frictional momentum between the bearing surfaces and the hub portion decreases over that exerted in the prior art systems.

As it is shown in FIGS. 3 and 4, projection 38 can be formed as a nose or pad, which has a stream-lined cross-section, for example, is drop-shaped so as to reduce the decrease in pressure of the water flowing through central passage 30 of hub 28 passed into central passage 32 of the mounting portion 14 of support arm 10.

As mentioned above, while the concept suggested herein is of particular advantage, if applied to asymmetric spray arm arrangements, it can also be applied to spray arm systems wherein the rotatable arm as such is designed to be balanced, such as standard two-legged spray arms or satellite spray arm systems, in which a two-legged support arm carries a spray arm on each of its legs. Also in such balanced spray arm systems the spray arm unavoidably will be subjected to temporary or continuously acting forces, which tend to tilt the mounting portion of the rotating arm with respect to its intended vertical rotational axis due to an uneven weight distribution within the rotating arm as it may be caused by an uneven water load within the legs of the arm or by water reaction forces of the water jets that are ejected from the spray arms onto articles within the washing compartment of the dishwasher.

In FIG. 5 there is shown a further embodiment of a spray arm arrangement in accordance with the present invention, which is particularly designed for spray arms, which are to be arranged below the roof of a washing compartment or below an upper dishwasher basket.

In particular, FIG. 5 shows an arrangement in which a one-legged spray arm 40 is rotatably mounted at a water feed passage 42 as it may be provided between an upper and a lower dishwasher basket. Similarly, arm 40 could be a support arm for supporting a rotatable spray arm. Spray arm 40 comprises a mounting portion, which is designed as a relatively short tubular section 44, which at its upper end comprises an outer angular rim 46 acting as first bearing surface. Mounting portion 44 and annular rim 46 are arranged within an annular hub section provided in the lower part of feed passage 42. Along its upper wall, feed passage 42 comprises a second annular hub section 50. Mounting portion 44 is provided with a projection 52 extending in parallel to the rotational axis 54 of spray arm 40. Protection 52 has a shape similar to projection 38 of the embodiment shown in FIG. 4, i.e. at least at its upper end, where it contacts the hub section 50, it has a circular outer shape. At its inner side, where projection 52 faces the feed passage 56 that is provided by the mounting portion 44, projection 52 preferably has a streamlined cross-section.

When in operation of the spray arm arrangement a force F1 acts on spray arm 40, which force may result from weight forces or water reaction forces, frictional forces F2 and F3 respectively have to be taken up at the first and second bearing surfaces. In view of the small radius r3 of the projection 52, frictional force F3 thus is kept at a minimum.

LIST OF REFERENCE SIGNS

10 support arm
12 axis of 10
14 mounting portion of 10
16 1st leg
18 2nd leg
20 spray arm
22 axis of 20
24 spray nozzle
26 spray nozzle
28 hub
30 central passage of 28
32 central passage of 14
34 first bearing surface
36 second bearing surface
38 second bearing surface
40 spray arm
42 feed passage

44 mounting portion of 40
46 annular rim
48 1st hub section
50 2nd hub section
52 projection
54 axis of rotation
56 central passage in 44

The invention claimed is:

1. Spray arm arrangement for a dishwasher, comprising:

(a) a hub;

(b) a spray arm having at least one arm portion comprising at least one spray nozzle;

(c) a generally tubular mounting portion extending between and terminating at a first end and a second end, the generally tubular mounting portion connected at the first end to the arm portion, said mounting portion having a first bearing surface bearing against the hub, said first bearing surface being located at a first axial distance from the arm portion; and (d) a projection which axially extends from and beyond the second end of said mounting portion along an axis defined through said generally tubular mounting portion into said hub, wherein said projection defines a second bearing surface extending parallel to and facing away from the axis defined through said generally tubular mounting portion, the second bearing surface bearing against the hub and being disposed at a second axial distance from the arm portion, wherein the first axial distance is shorter than the second axial distance, wherein the second bearing surface extends over only a section of the circumference of the mounting portion;

(e) wherein said first bearing surface is located within said hub, said first bearing surface facing away from the axis defined through said generally tubular mounting portion.

2. The spray arm arrangement of claim 1, wherein said hub comprises a central passage which is in alignment to a central passage provided in said mounting portion, wherein said second bearing surface axially extends from said mounting portion into the central passage of said hub.

3. The spray arm arrangement of claim 2, wherein the hub and the tubular mounting portion are configured to enable a cleaning liquid to flow through the hub and into the generally tubular mounting portion toward the spray arm, wherein said projection defining the second bearing surface, in the axial direction of the mounting portion, has a streamlined cross-section in the axial direction of the hub configured to minimize flow resistance of the projection within the flow of cleaning liquid.

4. The spray arm arrangement of claim 1, wherein said first bearing surface comprises one or more first projections located in a circumferential interface region between said hub and said mounting portion which provide for rotational support between the hub and the mounting portion substantially along the entire circumference of the mounting portion.

5. The spray arm arrangement of claim 4, wherein said one or more first projections comprises an annular rim.

6. The spray arm arrangement of claim 4, wherein said one or more first projections comprises a plurality of projections which are equally distributed about the circumference of the mounting portion.

7. The spray arm arrangement of claim 1, wherein said hub comprises a tubular member.

8. The spray arm arrangement of claim 1, wherein said hub comprises a tubular first section having generally a first radius for accommodating the first bearing surface and an annular second section having generally a second radius which is smaller than the first radius for accommodating the second bearing surface, said first and second sections of the hub being arranged at an axial distance so as to provide a feed opening there between for the passage of liquid.

9. The spray arm arrangement of claim 1, wherein said spray arm comprises a rotatable support arm comprising said mounting portion and a rotatable satellite arm comprising at least one satellite arm spray nozzle and being mounted on the support arm such that the axis of rotation of the satellite arm is offset with respect to the axis of rotation of the support arm, wherein said second bearing surface extends over only a section of the circumference of the mounting portion where during operation of the spray arm arrangement a momentum is exerted which has a vectorial component perpendicular to the axis of rotation of the support arm.

10. The spray arm arrangement of claim 9, wherein the support arm is designed to be asymmetric with respect to its axis of rotation.

11. The spray arm arrangement of claim 9, wherein at least one of said at least one spray nozzle of said spray arm is angled with respect to the axis of rotation of the support arm.

12. The spray arm arrangement of claim 1, wherein a single satellite arm is rotatably mounted on the spray arm.

13. The spray arm arrangement of claim 12, wherein the spray arm is a one-sided arm, one end of which comprises said mounting portion and the other end of which supports the satellite arm.

14. The spray arm arrangement of claim 12, wherein said spray arm comprises a first leg which supports the satellite arm, and a second leg opposite the first leg.

15. The spray arm arrangement of claim 14, wherein at least one of the at least one spray nozzle of the spray arm is provided in the second leg.

16. The spray arm arrangement of claim 1, wherein the arm portion extends from the mounting portion in a direction of extension, perpendicular the axis defined through the tubular mounting portion, wherein the second bearing surface extends around only a portion of a circumference of the mounting portion, and wherein the second bearing surface is positioned on the circumference opposite the direction of extension of the arm portion.

* * * * *